US005509621A

United States Patent [19]

Millett

[11] Patent Number: 5,509,621

[45] Date of Patent: Apr. 23, 1996

[54] MECHANISM FOR HIGH SPEED LINEAR PAYOUT OF MONO-FILAMENT STRAND

[75] Inventor: Scott B. Millett, Ridgecrest, Calif.

[73] Assignee: The United States of America as represented by the Secretary of the Navy, Washington, D.C.

[21] Appl. No.: 48,255

[22] Filed: Mar. 16, 1993

Related U.S. Application Data

[63] Continuation of Ser. No. 559,788, Jul. 30, 1990, abandoned.

[51] Int. Cl.[6] ..... F41G 7/32; B65H 49/02

[52] U.S. Cl. ..... 244/3.12; 242/128

[58] Field of Search ..... 244/3.12; 242/128, 242/159

[56] References Cited

U.S. PATENT DOCUMENTS

| | | | |
|---|---|---|---|
| 4,967,980 | 11/1990 | Pinson | 244/3.12 |
| 5,022,603 | 6/1991 | Maree et al. | 242/159 |
| 5,058,969 | 10/1991 | Peterson et al. | 244/3.12 |
| 5,100,078 | 3/1992 | Clark | 242/128 |
| 5,129,593 | 7/1992 | Smith | 242/128 |
| 5,167,382 | 12/1992 | Rochester et al. | 244/3.12 |
| 5,179,612 | 1/1993 | Rochester et al. | 244/3.12 |
| 5,189,253 | 2/1993 | Le Compte | 244/3.12 |
| 5,226,615 | 7/1993 | Schotter | 244/3.12 |

FOREIGN PATENT DOCUMENTS

| | | | |
|---|---|---|---|
| 2249820 | 5/1992 | United Kingdom | 244/3.12 |

*Primary Examiner*—Charles T. Jordan
*Assistant Examiner*—Theresa M. Wesson
*Attorney, Agent, or Firm*—Harvey A. Gilbert; Melvin J. Sliwka; John L. Forrest, Jr.

[57] ABSTRACT

A mechanism for dispensing a mono-filament strand, particularly adaptable for high speed strand dispensing, has an inner guide and an outer guide shaped so as to pay out or dispense the mono-filament strand, such as a fiber optic cable, between two objects moving relative to each other or one object moving relative to the other.

The inner and outer guides define cooperating surfaces of revolution, curved surfaces, and points of inflection between straight and curved surfaces that provide for strand pay out in which the strand or fiber does not contact or slide off a bobbin or over the inner guide so as to create bending stresses or angular accelerations that exceed the known physical limits of the strand or fiber material.

23 Claims, 3 Drawing Sheets

MECHANISM FOR HIGH SPEED LINEAR PAYOUT OF MONO-FILAMENT STRAND

This is a continuation of application Ser. No. 07/559,788 filed on Jul. 30, 1990, now abandoned.

BACKGROUND OF THE INVENTION

The present invention relates in general to a mechanism for dispensing a mono-filament strand at a high speed and pertains, more particularly, to a mechanism for dispensing a fiber optic cable between two objects moving relative to each other or one object moving relative to another. The mechanism of this invention provides a pay out device for dispensing fiber optic cable for communication between a weapon launched from an aircraft during flight and the aircraft.

With a conventional launch platform to launched weapon communications systems radio signals are transmitted through the air to maintain a desired communication between an aircraft and a weapon during flight of the weapon from the aircraft to the target.

Numerous strategic and tactical difficulties with these systems were likely incentives that spurred the development of wire guided weapons systems. It was recognized that radio frequency data links have numerous drawbacks associated with high-frequency electromagnetic (i.e., radio) transmissions through the air.

These drawbacks include terrain blocking high carrier frequencies required for high-bandwidth video transmissions requiring that a pilot of a launch aircraft must keep the launched weapon in sight until it hits an intended target. Plainly, if the pilot of the launch vehicle can see the weapon as it hits the target, then an air defense facility can see the launch aircraft, thereby making the launch aircraft vulnerable to anti-aircraft defenses.

Furthermore, radio frequency transmissions directed from an aircraft toward a weapon and the target are readily detected at the target defenses, thereby providing an unintended alert of the imminent attack. It is also possible to disrupt radio frequency transmissions in both directions, once detected, by jamming and thereby rend&ring the weapon ineffective. The development of wire guided weapon systems was a response to these and other drawbacks associated with radio frequency transmission data links.

The drawbacks of the high frequency radio frequency transmissions are typically inherent in the system and, therefore, generally inescapable and result in major tactical limitations. The detection and jamming drawbacks may be countered by use of sophisticated, expensive, and heavy frequency hopping, low-probability-of-intercept transmission techniques.

With a conventional wire guided weapon system a pay out mechanism for a thin wire is generally necessary to provide communications between the launching aircraft and a launched weapon. It is known to use the thin wire for communicating guidance and control signals.

The wire guided weapon systems have their own set of drawbacks stemming at least in part from the medium of signal transmission, that is the use of electrical transmissions through conductive wire. These systems are susceptible to jamming by enemy jamming signal sources.

The wire guided systems require a complete circuit path and therefore two wires. Both wires must pay out simultaneously. The use of two wires doubles the weight and complexity of the system with a corresponding probability of failure. The wire guided systems are limited in the use since operational flight paths are required that avoid entanglement of the wires.

It is desired that the wires are light and compact and therefore essentially unshielded and they tend to produce large electromagnetic fields. The field generation requires a large amount of power, thereby limiting the bandwidth. The result is a control system that can transmit control signals only from the launch point to the weapon. Thus, two-way transmissions at even low data transmission rates are not possible. This further means that high data transmission rate systems, such as video, are completely out of the question with wire guided systems.

The electrical potential or voltage developed between the two wires at the end associated with the transmission source must remain in part at the receiving end for the system to function. However, moisture and other conductive elements in the air, on the ground, or in the water with which the wires come into contact can partially or totally short-circuit the electrical path. This prevents any signal from reaching the receiver. The result is an inoperable data link.

The wire pairs form, in effect, an antenna. This antenna radiates the control signals being carried as well as capturing signals being broadcast around it. The wire data link is now detectable and jammable. It is known to counter enemy jamming signals of radio and direct wire communication links with equipment and techniques which are both expensive and sophisticated.

These known techniques typically encumber a weapon system with drawbacks such as additional costs, weight and/or size of the system, and overall operational complexity of the system. All of these factors are known to contribute to a lack of weapon system reliability.

The wire guided system drawbacks are inherent in the system and cannot be eliminated. Other transmission techniques that are available cannot be used because of the bandwidth limitations of a wire guided system.

These factors undoubtedly spurred the further development of wire guided communications systems in the direction of fiber optic communications systems. Fiber optic communications systems and data links of the type pertinent to the present invention offer a number of advantages.

They have lower energy requirements. The actual power transmitted through the fiber waveguide data link will be on the order of a milliwatt. The total electrical power consumption is on the order of twenty-five watts.

There are no detectable energy emissions. The energy radiated from the optical fiber data link is extremely low density. Thus, the probability of detection from energy radiation is insignificant.

Fiber optic data links resist jamming. An external signal (the jamming signal) cannot be directly coupled into a conventional functioning single mode fiber optic data link. The only way to jam a fiber optic link is to bathe a portion of the link in such an intense light at particular frequencies that the fiber begins to fluoresce.

However, even if the would be jammer detected the hair-fine, transparent fiber by means other than emissions, the density of the jamming energy which must be transmitted to intercept the invisible fiber would be enormous, for example on the order of several watts per square centimeter at the fiber and in the fluorescence-inducing bandwidth.

Fiber optics allow non-line-of-sight operation. Since the signals are guided down the center of an optic fiber, they will follow a curved fiber. Thus, the weapon can be launched from behind the cover of terrain and the launch platform can stay out of sight even while travelling away from the target for the entire duration of the weapon's flight.

An optical fiber waveguide data link functions in the high bandwidth range. Thus, the optical fiber waveguide data link will handle black and white or color video bandwidth from the weapon to an aircraft over extended ranges. The fiber optic data link allows receipt of video signals and simultaneous transmission of control signals in the opposite direction.

Yet, with all of the positive aspects of the fiber optic system, drawbacks still emerged. These drawbacks are associated with using fiber optic links for communications purposes and particularly where such links are required to be established and maintained between relatively moving objects, such as, a launch platform and a launched weapon.

Fiber optic links are known for use between missiles or bombs and launch vehicles which are fixed (e.g., truck mounted launcher) and mobile (e.g., attack aircraft). Both the fixed and mobile applications guide the weapon in flight. However, it is recognized that difficult problems and complexities are associated with fiber optic communications links between two high velocity airborne vehicles moving relative to each other in an hostile military operations environment.

It is recognized that a fiber optic link between two vehicles moving at a high velocity relative to each other is susceptible to breakage, entanglement, and other operational and environmental stresses. These drawbacks can adversely effect the physical integrity, function, and performance of the fiber optic communications system. A significant drawback exists in a potential for the fiber optic cable to become entangled or break during pay out from conventional free-helix fiber optic payout devices.

Conventional free-helix pay out systems have numerous problems associated with the three stages of their existence. First, protecting the delicate fiber from moisture, dust, and physical damage prior to weapon release. Second, initiating pay out by releasing the fiber. Third, permitting fiber pay out after release without breaking it.

All of the foregoing drawbacks stem from a free-helix pay out in which the fiber leaves the launch vehicle traveling in a relative direction opposite the flight path of the launch vehicle. Furthermore, the fiber is on a cylindrical surface with the same direction as the bobbin, which intercepts the bobbin's axis at the peel point.

During fiber pay out the fiber motion and path is determined by fiber tension and aerodynamic forces. If, for any reason, the bobbin or any other interfering surface of the vehicle intercepts the fiber path, then fiber damage and failure of the data link is likely.

As a result, the bobbin must be at the rear end of the launch vehicle, facing directly aft and in line with the current flight path. If the launch vehicle experiences any significant angle of attack in the pitch or yaw planes, then the fiber risks probable breakage.

Prior to weapon release and pay out a large circular hole through which a free fiber helix exits must be covered. The exit hole must be covered in such a way as to protect the optical fiber data link and the remainder of the vehicle interior from all external sources of damage.

In general, the larger the circular hole, the more difficult it is to effectively cover. The entire perimeter of the hole must stay environmentally sealed over a wide range of conditions. A six inch hole, for example has almost nineteen inches of perimeter over which a suitable seal must be maintained.

The cover referred to above must have the enviromental seal instantly and reliably removed from the hole at pay out initiation. Cover removal must occur in such a way so as to pose no threat of damage to the fiber, the weapon, the launch aircraft, or other aircraft flying in formation with the launch aircraft. The requirement of rapid release in only a few milliseconds and the transition from a tight environmental seal to a complete release is a significant reliability problem.

The hole referred to above creates a point at which the aircraft can be observed by hostile forces. Whether before, during, or after flight, the large hole in the launch aircraft through which the fiber exits will likely have different dielectric behavior than that of the surrounding surface of the aircraft. This observable discontinuity will result in a reflection at radar frequencies which can be unacceptable for aircraft incorporating low-observable technology.

Another drawback associated with fiber optic pay out systems is the problem of housing the cable in order to allow simultaneous pay out at a high rate of speed between a moving launch aircraft and a weapon released from the aircraft toward a distant target.

The optical fiber is normally stored and transported on spools or bobbins having a generally cylindrical shape or a tapered cone-like shape. The optical fibers are typically wound in a tight, closely packed helix about the outside diameter of the bobbin. When the optic fiber is dispensed, or paid out from the spool on the bobbin at high speed, it is known to pull the optic fiber off the bobbin in a direction generally parallel to a longitudinal axis of the bobbin and toward a small or truncated end of the cone.

It is known and frequently observed that if the optic fiber is wound on the bobbin in a helix pattern and then pulled from a point distant from the small end of the bobbin and along the longitudinal axis, then the optic fiber leaves the bobbin in the form of a helix. The helix of optic fiber has a helix diameter that gradually decays from a diameter approximately equal to the bobbin diameter to a diameter of essentially zero. The decay typically requires the pay out of optic fiber equal in length to many hundreds of bobbin diameters.

The form of the substantially unrestrained or free-helix and the helix decay rate are functions of the geometry of the bobbin and the fiber. Other factors include the bulk material properties (e.g., fiber density and stiffness are properties of primary concern), the coefficient of friction of the optic fiber on itself, and the drag characteristics of the fiber in the respective medium (e.g., air) through which it is paid out.

In many applications the fiber must be constrained to a helix diameter which is relatively small in comparison with the bobbin diameter, through a pay out length shorter than that typically required for the natural decay of the free-helix. This is normally accomplished by guiding the fiber through a conventional rigid guide ring having a desired inside diameter and oriented in a plane perpendicular to the axis of the bobbin and also concentric with this axis.

A serious drawback of these pay out systems is that the physics of the pay out dictate that the conventional rigid guide ring constrains the helix with a resulting tendency of the optic fiber helix to "balloon" resulting in the swelling of the helix diameter before the optic fiber has passed through the conventional guide ring. The swelling takes the shape of a smooth curve outward from the point where the optic fiber leaves the bobbin and before curving down to the diameter of the constraining ring.

The shape of the aforementioned curve is determined by the above indicated factors, the diameter of the conventional guide ring, and the distance from the conventional guide ring to the point where the optic fiber leaves the bobbin. Increasing the pay out velocity increases the maximum diameter of the "balloon". This increases the tensile and bending loads placed on the optic fiber as it passes through the conventional guide ring.

Yet other drawbacks to conventional fiber optic pay out systems include two practical velocity limitations in the actual application and use of conventional pay out systems. One limitation results from the tendency of the optic fiber to balloon as the velocity increases resulting in potential interference between the optic fiber and adjacent, fixed components of any associated fiber optic pay out mechanism.

Another limitation is the actual loading on the fiber itself of static and dynamic stresses as it passes through the conventional guide ring. These loads may eventually reach the strength limit of the optic fiber at a particular velocity resulting in fiber failure. The bending loads on the optic fiber are a particular concern for the optical fibers of a weapon system. Optical fibers are typically stiff, brittle monofilaments.

It will be recognized by those skilled in the art that the limitations related to optical fibers are applicable to monofilament strands in general as they are paid out through a constraint such as a guide ring. It will be understood from the objects and description of the present invention that this invention is readily applicable to solving equivalent problems in the bobbin, textile, and wound fiber art.

It is believed that the similar problems encountered in the textile industry with conventional textile fiber pay out mechanisms, the pay out mechanisms used in the manufacture of filament wound structures in general may use a mechanism similar to that set forth in the following specification and claims. However, for the purposes of clarity and precision, the described embodiment will be limited to a launch platform (e.g., aircraft) and weapon combination.

Two additional stress problems related to the free-helix pay out of mono-filament strands can occur if the natural helix decays rapidly enough such that the bobbin structure prevents the optic fiber from following that helix. These conditions can occur when the mono-filament strand pay out is from the end of the bobbin furthest from the direction of pull.

One stress problem has been observed to occur when the taper angle of the conical bobbin is less than the decay angle of the pay out helix. The optic fiber tends to wrap tightly around the bobbin, drag along the bobbin, and pull sharply in the direction of the longitudinal axis at the end of the bobbin.

Another problem occurs as a result of conditions in which the axis of the bobbin is not aligned with the pay out direction and the bobbin does not include the guide surfaces set forth below. In this condition the optic fiber is trying to pull its way through the bobbin along the bobbin surface farthest from the pay out direction. The fiber optic is forced to drag across the corner of the bobbin.

SUMMARY OF THE INVENTION

Accordingly, it is an object of the present invention to provide a mechanism for the high speed linear pay out of an optical fiber that provides a weapon communications link that is not susceptible to enemy jamming signals.

Another object of the present invention is to provide a mechanism for the high speed linear pay out of an optical fiber which significantly reduces entanglement or breakage of the fiber during pay out. The housing and bobbin construction of the present invention provides smooth pay out of the optical fiber both off the bobbin and out of the housing.

A further object of the present invention is to provide a mechanism for the high speed linear pay out of a mono-filament strand that may be adapted for general use with equipment related to mono-filament strand pay out or unwinding. The pay out mechanism housing and internal features of this invention is characterized by the lack of entanglement or breakage of the mono-filament strands and may be adapted for use with other fiber or thin monofilament pay out or dispensing systems.

Still another object of the present invention is to provide a mechanism for the high speed linear pay out of a mono-filament strand that is adapted to address the dual problems of mono-filament strand ballooning and bobbin drag.

Still a further object of the present invention is to provide a mechanism for the high speed linear pay out of a mono-filament strand that is constructed to incorporate shaped guide surface relationships to reduce or eliminate problems related to pay out velocity and related mono-filament strand stresses.

Another object of the present invention is to provide a mechanism for the high speed linear pay out of a mono-filament strand that addresses both problems of ballooning and drag. The mechanism is constructed to provide shaped guide or control surfaces to control and therefore reduce the problems associated with mono-filament strand pay out.

A further object of the present invention is to provide a mechanism for the high speed linear pay out of a mono-filament strand that generally reduces mono-filament strand ballooning and mono-filament strand drag across a bobbin. An outer guide means surrounds the bobbin member and prevents uncontrolled free-helix ballooning of the mono-filament strand and an inner guide means prevents the mono-filament strand from dragging over an end of the bobbin.

Still another object of the present invention is to provide a mechanism for the high speed linear pay out of a fiber that accomplishes the desired results in a relatively short or compact length. The mechanism of this invention is compact in length along the bobbin axis, a feature desirable for incorporation of this invention with a combination launch aircraft and weapon system.

A further object of the present invention is to provide a mechanism for the high speed linear pay out of an optical fiber that improves on conventional data link systems. The linear pay out of the present invention is a further improvement in the high speed pay out of optical fiber, in particular the currently used free helix pay out mechanisms.

Still another object of the present invention is to provide a mechanism for the high speed linear pay out of an optical fiber data link. During pay out the fiber exiting a linear pay out system of the present invention may be deflected from the bobbin's axis about a deflecting surface. As a result the bobbin location becomes flexible and the exiting optical fiber can be routed around other components of the launch vehicle or launched weapon to exit in a desired location.

Still a further object of the present invention is to provide a mechanism for the high speed linear pay out of an optical fiber data link including an exit flare surface permitting pay out while the vehicle is in severe angles of attack without risking fiber breakage. This object increases the flexibility of the tactical application of this invention.

Another object of the present invention is to provide a mechanism for the high speed linear pay out of an optical fiber data link having a relatively small exit orifice which will be easier to seal prior to pay out. The cover required for the present invention should be small enough to retain with the vehicle and should pose relatively small risk of ingestion by an aircraft engine. The small cover will be low mass, short perimeter length, and easily and rapidly removable with a corresponding improvement in reliability.

A further object of the present invention is to provide a mechanism for the high speed linear pay out of an optical fiber data link in which the relatively small size of the linear pay out exit orifice will not be readily observable. The present invention lends itself to low-observable applications and the small discontinuity is expected to have a minimal effect on the radar signature of the launch vehicle.

Still a further object of the present invention is to provide a mechanism for the high speed linear pay out of a fiber, filament or other mono-filament that has general application in the textile or filament wound structure industry.

Another object of the present invention is to provide a mechanism for the high speed linear pay out of a mono-filament strand that is reliable, even under extreme or severe conditions.

To accomplish the foregoing and other objects of this invention there is provided a mechanism for the pay out of a mono-filament strand. The mechanism comprises a bobbin for receiving a mono-filament strand which is wound on the bobbin in a helix. The bobbin has a longitudinal axis that provides a reference point for defining additional strand guide means and surfaces.

An outer guide means is provided which includes an inward facing guide surface for guiding the mono-filament from the bobbin to the outlet. An inner guide means is provided that guides the strand pay out in cooperation with the outer guide. The inner guide further defines a desired surface of revolution generated by an imaginary arc relative to the longitudinal bobbin axis and in a plane including the longitudinal axis.

The cooperation of these guide means provides mono-filament strand pay out such that the mono-filament strand does not contact or slide along any surface with a radius which would permit sharp bend radii in the mono-filament strand sufficiently to produce bending stresses and angular accelerations exceeding known material limits or physical properties of a particular mono-filament strand.

In preferred embodiments the relationships between the outer guide means, the inner guide means, and strand pay out can be expressed as functions of strand diameter. The illustrated embodiments identify approximate strand diameters for the optical fiber embodiment. It will be understood that the mechanism or this invention may be applied to the pay out or dispensing of other mono-filament strands with known or identifiable properties.

The present invention comprises a method for guiding pay out of a mono-filament strand including the steps of winding the mono-filament strand on a bobbin in a helix about the bobbin longitudinal axis and then guiding the strand through the outer guide means and the inner guide means without permitting sharp bend radii in and the undesirable ballooning that can occur with conventional free-helix pay out devices.

These and other objects and features of the present invention will be better understood and appreciated from the following detailed description of one embodiment thereof, selected for purposes of illustration and shown in the accompanying drawings.

DETAILED DESCRIPTION

Figure 1:
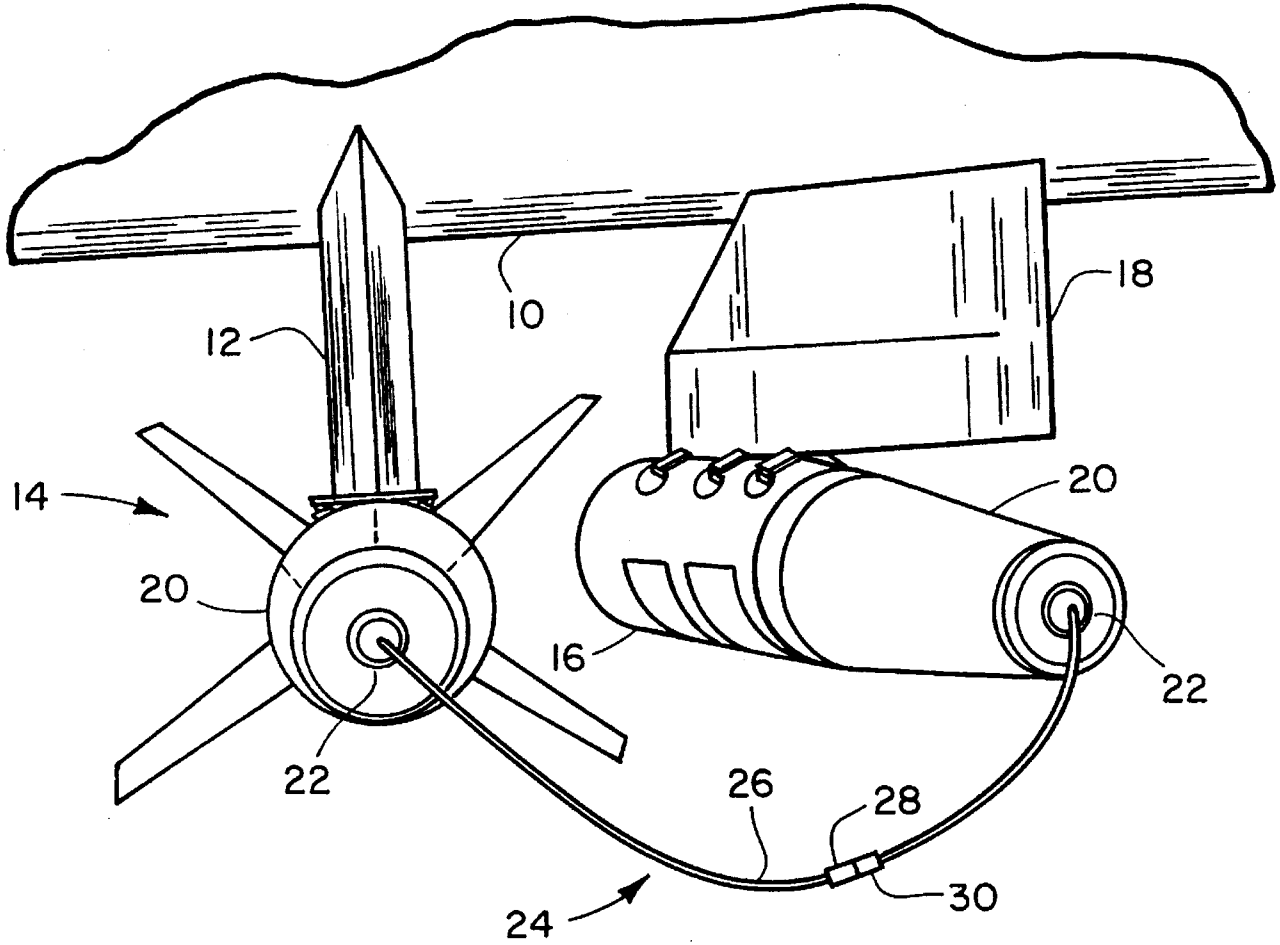
FIG. 1 is a perspective view of the invention operationally mounted on a launch aircraft.

Referring now to the drawings there is shown a preferred embodiment for the high speed linear pay out mechanism of this invention. The mechanism is described in connection with an aircraft to weapon communications system. The high speed linear pay out mechanism of the present invention is particularly adapted for providing fiber optic communications cable dispensing and is characterized by a reduction in cable ballooning and bobbin drag problems.

The drawings show an aircraft 10 in conjunction with a weapon communications pod 16 shown secured to the aircraft by means of a mounting rack 18. A weapon 14 is similarly depicted secured to the aircraft by means of a mounting rack 12. Identical housings 20 of the present invention are shown affixed to rear portions of both the aircraft pod 16 and the weapon 14.

The aircraft pod 16 contains elements for communicating between the aircraft and the pod and processing elements for handling signals received back from that part of the invention within the housing 20 attached to the aircraft pod 16 from the elements of the invention within the housing 20 attached to the weapon 14. An unwound fiber optic cable portion 24 of the fiber optic cable between the two housings extends through an outer guide 22 at the rear end of each of the housings 20 and constitutes an interconnect cable 26 between the two housings.

Figure 3:
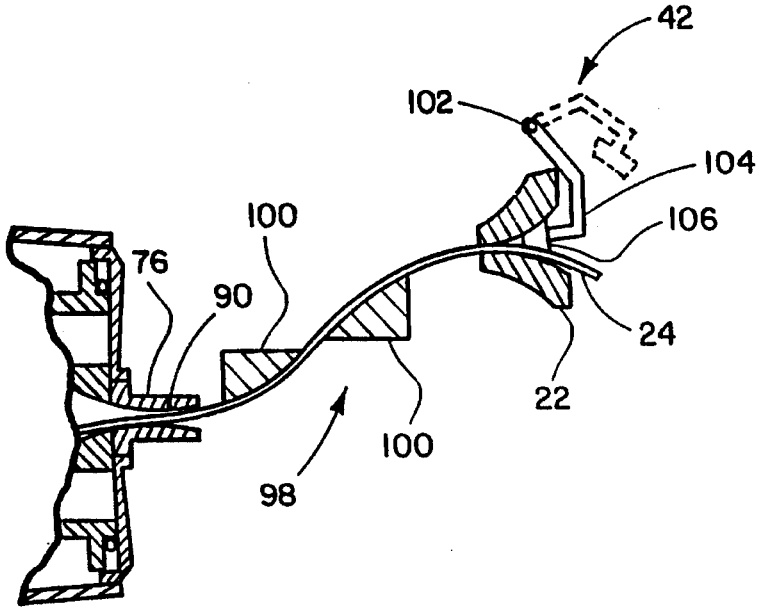
FIG. 3 is an exploded sectional view depicting another embodiment of an outlet guide extension and seal assembly.
Figure 4:
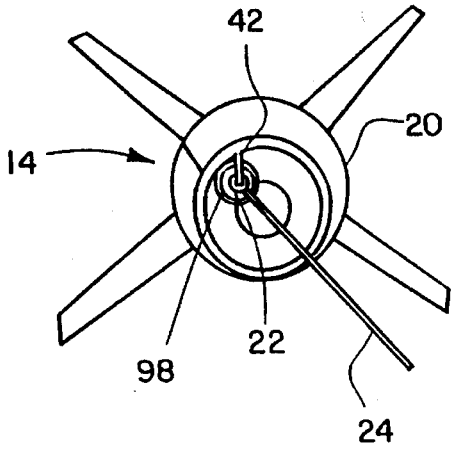
FIG. 4 is a partial perspective view depicting the embodiment illustrated in FIG. 3.

The interconnect cable between the two housings is secured against premature release at the rear of each outer guide 22 with a retain/release mechanism 42, as seen in FIGS. 3 and 4, which, upon pay out initiation, is intended to release the interconnect cable 26. Aerodynamic drag on the interconnect cable 26 begins extracting the wound fiber optical cable 44 from the bobbin 38.

The retain/release mechanism 42 and exit assembly 98 provides an exit flare for deflecting the unwound fiber optic cable portion 24. A pivot point 102 is provided for the movement of an arm 104. A stopper 106 is moved by the arm 104 to release the fiber 24 for pay out. The pivot point 102 may be located at a suitable attachment point on either the launch vehicle or the launched weapon.

The stopper may be a neoprene material or other suitable material that can provide an acceptable seal while not damaging the fiber optic cable. The stopper 106, in a preferred embodiment is selected to seal around the unwound fiber optic cable portion 24.

It is known to provide some form of a cable sheath for the optical cable. The point at which sheath ends of the fiber optic cable between the two housings 20 join is a splice 28 within shrink tubing 30 as seen in FIG. 1.

Figure 2:
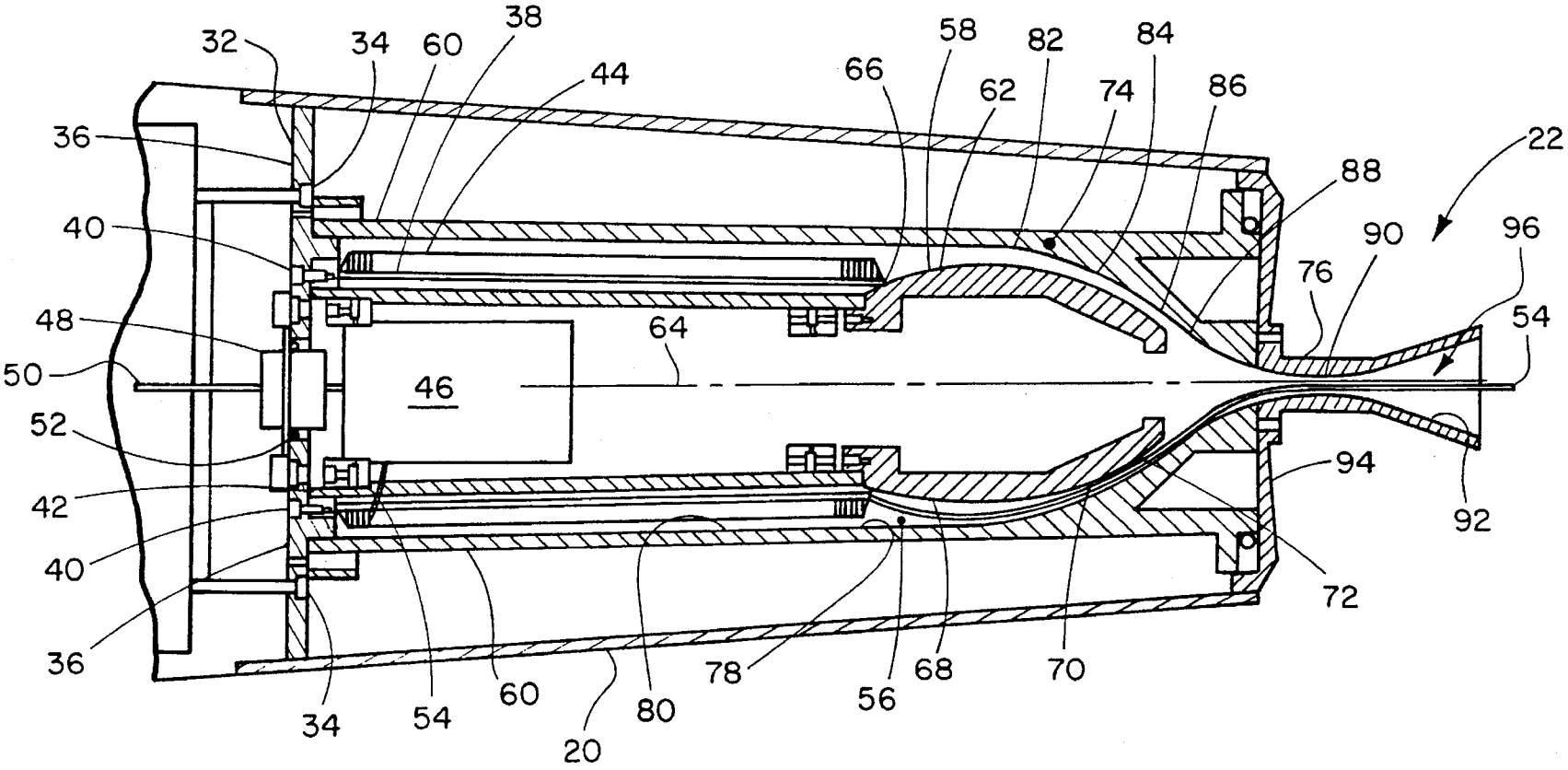
FIG. 2 is a sectional view taken at a centerline of the fiber optic pay out portion of the invention and deployed for operation as part of an aircraft to weapons communication pod or as part of the controllable weapon.

Details of one preferred embodiment of the present invention within each of the housings 20 are shown in FIG. 2. The housings 20 are secured by way of an inner support structure 32 secured to the pod 16 by means of bolts 34. A rear wall 36 of the inner support structure 32 provides the support for a bobbin 38 attached to the rear wall by means of bolts 40.

Within the housings 20 the bobbin 38 is secured with its longitudinal axis 64 coincident with the longitudinal axis of the aircraft pod 16 or the weapon 14. This is typically accomplished by mounting the pod, either 14 or 16, with its aft or rear end secured to the rear wall 36 by means of the bolts 40. It is of course unnecessary for the function of the present invention to ensure that these axes are coincident.

A helix wound portion 44 of the fiber optic cable about the bobbin 38 has one end attached or connected to a transmitter/receiver 46 which is in turn connected through a connector 48 through the rear wall 36 of the inner support structure 32 to the signal cable 50 connecting with the weapon 14 or the aircraft pod 16.

An O-ring 52 may be placed between the connector 48 and the rear wall 36 of the inner support structure 32 in order to further secure the present invention from adverse environmental influences.

At the aft end of the bobbin 38 as depicted in FIG. 3, which is the smaller end, the fiber optic cable 54 extends as the unwound portion 24 through the outer guide 22.

It will be understood that in the following description of a typical operation of this invention similar elements of this invention within each of the housings 20 are essentially the same and pay out occurs, for practical purposes, simultaneously.

It will now be understood that the mechanism for guiding high speed pay out of a mono-filament strand or optic fiber in the described embodiment includes the bobbin 38 for receiving a mono-filament strand wound on the bobbin in a helix pattern. Inner and outer guide means will now be described in detail with respect to two preferred embodiments.

In FIG. 2 inner guide 58 is located within an outer guide 60. The pay out mechanism depends upon cooperation between the outward facing guide surface 62 of the inner guide 58 and the inward facing guide surface 78 of the outer guide 60. The outward facing guide surface 62 is defined by a surface of revolution revolved about a longitudinal bobbin longitudinal axis 64.

As will be discussed, the purpose of the surface of revolution and its particular relationship with the outer guide 60 and the bobbin 38 is to guide the optic fiber cable 54 as it leaves the bobbin. The fiber is guided between the inner and outer guides and then out of the housing 20. The fiber will not contact or slide along any surface with a radius which would unacceptably permit sharp bend radii in the fiber and produce bending stresses or angular accelerations exceeding known material limits of the fiber.

Referring now to one of the illustrated embodiments, the optic fiber 44 is wound on the bobbin 38 in a helix pattern. The conventional bobbin may taper in the direction of optic fiber pay out. The inner guide 58 surface of revolution includes a component 66 adjacent the bobbin 38 and located within a recessed portion of the tapered end of the bobbin. It will be understood that the outer facing guide surface 62 of revolution is defined by an arc of constant radius generated in a plane containing the longitudinal axis of the bobbin.

The inner guide 58 extends from the bobbin end 66 of the surface of revolution, through an intermediate tangent point 68 to an outer end 70. The inner guide 58 includes an inner guide transition portion 72 where the outer end 70 of the inner guide 58 obtains a convenient radius and shape for maintaining a desired clearance between the inner and outer guides 58 and 60 respectively.

The outer guide 60 of one preferred embodiment includes a first outer guide member 74 and an associated second outer guide member 76. Together the joined outer guide members define an outer guide inner surface 78. The surface 78 is composed of a number of surface portions that can be identified and that contribute to the desired operation of the mechanism of this invention. An outer guide inner surface bobbin portion 80 is generally adjacent the bobbin 38.

A transition portion 82 extends generally intermediate the bobbin 38 or inner surface portion 80 and a tangential arc portion 84. The outer guide inner surface is substantially parallel at 80 to an outer layer of the optic fiber wound on the bobbin and closely spaced to prevent ballooning. The parallel surface portion extends the length of the bobbin in a preferred embodiment and ends approximately in the region of the transition portion 82, which closely follows the outward facing surface 62 of the inner guide 58.

The inward facing guide surface 78 of the outer guide 60 further defines an inflection point 86 at which the radius surface of the inner facing surface changes to a reverse curve portion 88 of the same radius but opposite direction of the tangential arc portion 84. The inner facing surface continues to define the opposing reverse curve through a minimum diameter opposite radius tangent portion 90 of the reverse curve.

The portion 90 is tangent to an imaginary line spaced from the longitudinal axis 64 an optimum distance. In the illustrated embodiment the optimum distance is determined by the ability to machine the second outer guide member 76. The optimum distance can be expressed as a distance which will produce a desired fiber exit helix diameter. The opposite radius tangent portion is within an exit cone portion 92 of the outer guide.

The relationship between the inner guide means 58 and the outer guide means 60 of a preferred embodiment will now be described in greater detail.

The radius of the surface of revolution or the arc that defines the surface of revolution arc extends from just within the recessed end of the bobbin at 66 and extends to the tangent point 68. In the preferred embodiment the tangent point is defined by an imaginary line approximately two or more fiber diameters from an outer surface of an outer layer of fiber wound on the bobbin 38 and parallel to the outer layer.

The surface of revolution of the inner guide 58 extends to the outer end 70. The outer end 70 is located at a convenient point aft of the tangent point of the surface of revolution with respect to a line which is also tangent to the outer guide inward facing guide surface 78.

The inner guide transition portion 72 provides a radial transition to any advantageous shape. The radial transition preferably provides a clearance between the inner and the outer guide from approximately five to and including fifteen fiber diameters.

The outer guide 60, as already discussed, extends generally parallel to the bobbin 38 and the wound optical fiber 44 from the end of the bobbin farthest from the exit cone 92. In the preferred embodiment described and illustrated herein, the outer guide 60 maintains a clearance of approximately four fiber diameters from the outer fibers on a fully wound bobbin.

The inward facing guide surface 78 of the outer guide 60 transitions at point 82 to an arc 84 which is concentric to surface 62 and is approximately from five to and including fifteen fiber diameters spaced apart from the surface 62. There is another transition, a point of inflection 88, at which the following segment 92 forms an arc of equal radius to segment 84 but on the outside of the surface, such that segments 84 and 92 are tangent at point of inflection 88.

The radius of outward facing guide surface 62 of the inner guide 58, and the related radii of segments 84 and 92 of the inward facing surface of the outer guide 60, are selected such that the angle of the outer guide 60 at point 88, and therefore the maximum deflection angle of the fiber helix relative to the axis 64 of the bobbin 38, will be optimized while maintaining the maximum possible radius.

Referring again to the drawing figures, two embodiments of an exit arrangement are depicted. The first arrangement describes an extended exit assembly 98 (FIGS. 3 and 4). The second arrangement is a foreshortened assembly (FIGS. 1 and 2).

The exit orifice 90 of the inward facing guide surface 78 of the outer guide 60 is located at the minimum diameter. The minimum diameter is also the tangent point with respect to the bobbin axis. The outer guide 60 may have an extension 98 seen in FIG. 3, of an indeterminate length. In one preferred embodiment the outer guide extension 98 includes a plurality of intermediate deflection surfaces represented by reference character 100. The surfaces are provided within the extension 98 and will be shaped and sized to provide the desired deflection for the unwound optic fiber cable data link 24.

The intermediate surfaces 100 shown in FIG. 3, serve to deflect the unwound portion of fiber optic cable 24 and to permit transport of the fiber from the bobbin 38 to a convenient point of departure in the exit cone discharge portion 96 from the vehicle or weapon. It will be understood that the point of fiber departure need not be along the axis 64 of the bobbin 38, nor must the direction of travel of the fiber at departure from the mechanism of the present invention be parallel to the bobbin axis.

Preliminary tests on a prototype modified as generally indicated in FIG. 3 achieved a pay out speed of over 800 ft/sec before failure. It is expected that a preferred embodiment of the present invention would incorporate the guide surfaces of FIG. 3 or their equivalents, if the overall vehicle configuration allows.

The retain/release mechanism 42 can also be applied to the foreshortened embodiment, although not shown in FIGS. 1 and 2. A conventional seal arrangement used with existing conventional free-helix bobbin assemblies could also be adapted for use with the present invention.

In broad terms, it will be understood that the inner guide 58 and outer guide 60 provide a dispensing mechanism that does not allow the fiber to slide upon or contact any surface that is rigid and that has an instantaneous longitudinal radius less than the specified minimum.

In operation, in connection with the fiber optic pay out device for use to dispense fiber optic cable for communication between a weapon launched from an aircraft during flight and the aircraft, the aircraft 10 receives the weapon 14 on the associated weapon mounting rack 12 and the weapon communications pod 16 on the pod mounting rack 18. The weapon and the communications pod both carry their respective pay out housings 20. In FIGS. 1 and 4 the outer guide member outlets 22 are illustrated.

Upon activation of the retain/release mechanism 42, aerodynamic drag on the unwound portion 24 of the fiber optic cable which constitutes the interconnect cable 26 between the weapon 14 and the aircraft pod 16 begins pulling on the helix wound coil of fiber optic cable about the bobbin 38 in each of the housings 20. The immediate result is that the wound portion 44 of the fiber optic cable 54 inside the housings 20 begins moving outward.

The opposite end of the fiber optic cable 54 on the forward end of the bobbin 38 extends and is connected to the transmitter/receiver 46 for communication between the weapon 14 and the aircraft pod 16 by means of their respective transmitter/receivers 46.

The bobbin pay out housings 20 are positioned and the free ends of the optic fiber are connected as suggested by the illustrated splice 28 and associated shrink tubing 30.

Upon weapon launch the optical fiber begins to pay out from both housings. The optical fiber is wound on the bobbins in a helix pattern. The fiber pay out is guided by the inward facing surface 80, 84, and 88 of the outer guide 60 and the outward facing guide surface 62 of the inner guide 58. The fiber pays off the bobbin and the fiber pay out helix is collapsed to permit near straight line pay out through exit orifice 90 without permitting unacceptable fiber bending to occur.

It will be understood now that the goal of the mechanism of the present invention is to constrain the pay out helix of the fiber to a small diameter without permitting sharp bend radii in the fiber as it pays out.

As the inner guide 58 is adapted to fit within the bobbin recess, the fiber does not contact or slide off the bobbin and over the inner guide so as to create bending stresses or angular accelerations that exceed the known physical limits of the fiber material.

The optical fibers 44 are typically wound in a tight, closely packed helix about the outside diameter of the bobbin 38. The optic fiber is dispensed or paid out from the bobbin at high speed in a direction generally parallel to the longitudinal axis 64 of the bobbin, toward the tapered end and the exit orifice 90. The optic fiber 54 leaves the bobbin in the form of a helix. The fiber helix extends between the inner guide 58 and the outer guide 60.

As the fiber is pulled off the bobbin, fiber ballooning is restricted by the inward facing guide surface 78 of the outer guide 60. This restriction extends from the farthest point of the bobbin from the exit orifice 90 to the end of the bobbin closest to the exit orifice.

The inward facing guide surface 78 is spaced from the outer strand of fiber on the bobbin a sufficient distance so as to allow the dispensing helix to form, yet restrain the helix within an acceptable instantaneous longitudinal radius which is less than that which would create fiber bending stresses and fiber angular accelerations outside of acceptable material limits. In the illustrated embodiment the inward facing guide surface 78 of the outer guide 60 is positioned at least approximately four fiber diameters from the outer fiber strand wound on the bobbin 38.

The inner guide 58 provides the outward facing surface 62 of revolution which extends into the bobbin recess. As the fiber leaves the bobbin the inner guide 58, and more particularly, the bobbin end surface of revolution 66, prevents the fiber from obtaining excessive bending stresses where the fiber actually quits the bobbin. Since the inner guide 58 extends into the bobbin recess, there is no gap or unsupported fiber portion as the fiber extends between the inner and the outer guides 58 and 60, respectively. The fiber is restricted into a relatively linear pay out configuration.

From the foregoing description those skilled in the art will appreciate that all of the objects of the present invention are realized. A mono-filament strand pay out mechanism has been shown that provides for the high speed linear pay out of a fiber or strand such as an optical fiber that provides a weapon communications link. The mechanism allows linear high speed pay out of the strand without ballooning or the resulting entanglement of breakage that typically results in conventional strand pay out mechanisms.

The pay out mechanism of the present invention is readily adaptable for general use with equipment related to mono-filament strand pay out or unwinding. The pay out mechanism housing and internal features of this invention are characterized by the lack of entanglement or breakage of the mono-filament strands and may be adapted for use with other fiber or thin monofilament pay out or dispensing systems.

The high speed linear pay out mechanism improves upon conventional pay out mechanisms by reducing strand ballooning with a linear pay out and increasing pay out speed by reducing strand drag within the pay out mechanism. The linear pay out allows higher pay out speeds without the strand being subjected to damaging stress, found in conventional pay out mechanism and caused in part by the extreme strand bend radii experienced during free-helix pay out.

It will be further understood that the bobbin diameter and proportions may be changed for different applications. The changes could be based upon the nature and location of the volume available for the optical fiber data link, or other suitable filament, strand, or fiber material utilizing the bobbin of the present invention.

The present invention provides for the deflection of the fiber or strand during pay out by use of a deflecting surface, and as a result the bobbin location becomes flexible thereby allowing the exiting optical fiber or other mono-filament strand to avoid interfering with adjacent structure.

The present invention includes an exit flare surface permitting pay out while the vehicle is in severe angles of attack without risking fiber breakage and increases the flexibility of the tactical application of the present invention.

The relatively small exit orifice is easier to seal prior to pay out and the cover required for the present invention should be small enough to retain with the vehicle and pose only a relatively small risk of ingestion by an aircraft engine. The small cover will be low mass, short perimeter length, and easily and rapidly removable with a corresponding improvement in reliability.

The relatively small size of the linear pay out exit orifice will not be readily observable and lends the tactical application of the present invention to use in low-observable applications where the small discontinuity is expected to have a minimal effect on the radar signature of the launch vehicle.

While specific embodiments have been shown and described, many variations are possible. The particular construction of the supporting structure including all of the sizes of the support structure components may be changed as desired to suit the equipment and application with which the present invention is used. The mono-filament strand materials may vary although the preferred embodiment is used in connection with an optical fiber.

The use of the inner guide and its surface of revolution extending in a bobbin recess and the outer guide with its inflection point and reverse curve arrangement may vary in strand diameter displacement with the use of various mono-filament strand types. Any modifications will become apparent to one skilled in the art, however, upon a comparison of the physical properties of various strands with respect to the optical fiber of the preferred embodiment.

The present invention is a function of fiber or strand diameters and bobbin configuration. While this feature of the invention contemplates its broad application to the dispensing of mono-filament fibers generally, it will be understood that other considerations in applying this invention must include the manufacturing tolerances of the strands and the possibility that the fiber diameters set forth for the optical fiber application may vary when applied to strands with other physical property values.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A mechanism for guiding pay out of a monofilament strand, comprising:

a bobbin for receiving a mono-filament strand wound on the bobbin in a helix, the bobbin having a longitudinal axis;

outer guide means including an inward facing guide surface for guiding the mono-filament as it leaves the bobbin, the outer guide means further including a mono-filament strand pay out outlet; and inner guide means cooperating with the outer guide means and having an outward facing guide surface including a surface of revolution about the longitudinal bobbin axis for guiding the mono-filament strand as it leaves the bobbin between the inner guide means and the outer guide means, and through the pay out outlet, whereby the mono-filament strand pay out occurs such that the mono-filament strand does not contact or slide along any surface with a radius which would permit sharp bend radii in the mono-filament strand sufficiently to produce bending stresses and angular accelerations exceeding known material limits of the mono-filament strand, wherein the surface of revolution comprises:

an arc on the outward facing surface of the inner guide means extending into a recessed end of the bobbin at an end nearest the outlet, the end of the bobbin receiving the adjacent arc portion of the surface of revolution; and the arc extending to a tangent point on an imaginary line spaced from the outer surface of the outer layer of mono-filament strand wound on the bobbin.

2. A mechanism as set forth in claim 1 wherein the imaginary line is spaced, at the tangent point, an optimum distance from and parallel to the outer layer of the mono-filament strand wound on the bobbin.

3. A mechanism as set forth in claim 2 wherein the optimum distance is greater than or equal to approximately two strand diameters.

4. A mechanism as set forth in claim 1 wherein the inner guide means comprises a radial transition portion of the arc extending past the tangent point and proximate the outlet and spaced away from the adjacent outer guide means portion.

5. A mechanism as set forth in claim 4 wherein the radial transition portion maintains an optimum spacing from an adjacent portion of the outer guide means.

6. A mechanism as set forth in claim 5 wherein the optimum spacing is approximately between five and fifteen strand diameters, inclusive.

7. A mechanism as set forth in claim 1 wherein the outer guide means comprises a transition portion providing a smooth transition between an outer guide means bobbin portion, which is parallel to the outer layer of wound fiber on the bobbin and extends to a point near and adjacent to the tangent point of the inner guide means, and a tangential arc portion, adjacent to and extending past the tangent point on the inner guide means towards the outlet.

8. A mechanism as set forth in claim 7 wherein the outer guide means transition portion transforms an inward facing surface of the outer guide means from the transition portion to the tangential arc portion and is spaced an optimum distance, measured in the number of strand diameters, from the inner guide means tangent portion, the distance being sufficient to restrain a helix formed as the fiber unwinds from the bobbin within an acceptable instantaneous longitudinal radius to reduce stresses and reduce the helix diameter.

9. A mechanism as set forth in claim 8 wherein the optimum distance extends past the end of the inner guide means and at least to an inflection point on the outer guide means inward facing surface where the outer guide means inward facing surface converts to a curve having the same, although opposite, curve radius.

10. A mechanism as set forth in claim 9 wherein the optimum spacing is approximately from five to fifteen strand diameters, inclusive.

11. A mechanism as set forth in claim 1 wherein the outer guide means comprises an inward facing surface having a first radius curve and a second opposite radius curve having the same radius as the first radius curve but measured from the opposite side of a tangent line, with the change in curve radius direction defined by an intermediate inflection point, the inflection point also being a common tangent point to form the tangent line.

12. A mechanism as set forth in claim 11 wherein the opposite radius curve defines a tangent to the bobbin longitudinal axis at an optimum distance greater than a desired helix diameter of the strand as the strand exits the payout outlet.

13. A mechanism as set forth in claim 12 wherein the opposite radius curve extends to further define an exit means.

14. A mechanism as set forth in claim 13 wherein the exit means further comprises an exit cone having the radius of the opposite radius curve, whereby the exit cone provides for desired strand pay out and any expected misalignment between the bobbin and strand being dispensed.

the arc remaining tangent to an imaginary line spaced from the outer surface of the outer layer of monofilament strand wound on the bobbin, the arc spaced at the tangent point an optimum distance from the outer layer of the fiber optic cable helix wound on the bobbin.

15. A mechanism for dispensing a fiber optic cable between two objects experiencing relative movement, the mechanism comprising:

a bobbin, the bobbin having a longitudinal axis through the bobbin center;

a length of fiber optic cable for providing a data link between a first object and a second object, at least a portion of the length of fiber optic cable wound in a helical pattern on the bobbin;

outer guide means including an inward facing guide surface for guiding the fiber optic cable as it leaves the bobbin, the outer guide means further including a fiber optic cable pay out outlet; and inner guide means cooperating with the outer guide means and having an outward facing guide surface including a surface of revolution about the longitudinal bobbin axis for guiding the fiber optic cable as it leaves the bobbin between the inner guide means and the outer guide means, and through the pay out outlet, whereby the fiber optic cable pay out occurs such that the fiber optic cable does not contact or slide along any surface with a radius which would permit sharp bend radii in the fiber optic cable sufficient to produce bending stresses and angular accelerations exceeding known material limits of fiber optic cable suitable for use as a data link;

the bobbin at an end nearest the pay out outlet, receiving the adjacent arc portion of the surface of revolution; and the arc remaining tangent to an imaginary line spaced from the outer surface of the outer layer of monofilament strand wound on the bobbin, the arc spaced at the tangent point an optimum distance from the outer layer of the fiber optic cable helix wound on the bobbin.

16. A mechanism as set forth in claim 15 wherein the optimum distance is greater than or equal to approximately two optic fiber diameters.

17. A mechanism set forth in claim 15 wherein the inner guide means comprises:

a radial transition portion of the arc extending past the tangent point on the outward facing surface and proximate the outlet and spaced away from the adjacent outer guide means portion, the radial transition portion maintains an optimum spacing from an adjacent portion of the outer guide means.

18. A mechanism as set forth in claim 17 wherein the optimum spacing is approximately between five and fifteen optical fiber diameters, inclusive.

19. A mechanism set forth in claim 15 wherein the outer guide means comprises:

an outer guide means transition portion providing a smooth transition between an outer guide means bobbin portion and a tangential arc portion;

the outer guide means transition portion transforms and inward facing surface of the outer guide means from the transition portion to the tangential arc portion and spaced an optimum distance, measured in number of optical fiber diameters, from the inner guide means tangent portion; and the optimum distance extending past the end of the inner guide means and at least to an inflection point on the outer guide means inward facing surface where the outer guide means inward facing surface converts to a curve having the same, although opposite, curve radius, and the optimum distance being sufficient to restrain a helix formed as the fiber unwinds from the bobbin within an acceptable instantaneous longitudinal radius to reduce stresses and reduce the helix diameter.

20. A mechanism as set forth in claim 19 wherein the optimum distance is approximately from five to fifteen optical fiber diameters, inclusive.

21. A mechanism as set forth in claim 15 wherein the outer guide means comprises:

an inward facing surface having a first radius curve and a second opposite radius curve having the same radius with the change in curve radius direction defined by an intermediate inflection point;

the opposite radius curve defines a tangent to the bobbin longitudinal axis at an optimum distance greater than a desired strand exit helix diameter;

the opposite radius curve extending through to further define an exit means; and the exit means further comprises an exit cone having the radius of the opposite radius curve, whereby the exit cone provides for desired optic fiber pay out and any expected misalignment between the bobbin and the optic fiber being dispensed.

22. A mechanism as set forth in claim 15 wherein the optic fiber pay out outlet further includes an optic fiber deflection means for deflecting the exiting optic fiber.

23. A mechanism as set forth in claim 22 wherein the optic fiber deflection means includes a deflection surface provided as an effective extension of the pay out outlet.

* * * * *